US005253624A

United States Patent [19]

Anzai et al.

[11] Patent Number: 5,253,624

[45] Date of Patent: Oct. 19, 1993

[54] IDLING SPEED CONTROL SYSTEM OF INTERNAL COMBUSTION ENGINE

[75] Inventors: Makoto Anzai; Yoshinori Yamamura, both of Kanagawa Pref., Japan

[73] Assignee: Nissan Motor Co., Ltd., Yokohama, Japan

[21] Appl. No.: 959,623

[22] Filed: Oct. 13, 1992

[30] Foreign Application Priority Data

Oct. 14, 1991 [JP] Japan ..... 3-264563

[51] Int. Cl.[5] ..... F02M 3/00; F02B 23/00

[52] U.S. Cl. ..... 123/339; 123/585

[58] Field of Search ..... 123/339, 327, 325, 340, 123/585

[56] References Cited

U.S. PATENT DOCUMENTS 5,080,061 1/1992 Nishimura ..... 123/339
5,094,207 3/1992 Krampe et al. ..... 123/339
5,111,788 5/1992 Washino ..... 123/339
5,140,960 8/1992 Fujimoto et al. ..... 123/339
5,163,399 11/1992 Bolander et al. ..... 123/339
5,172,665 12/1992 Kuroda ..... 123/339

FOREIGN PATENT DOCUMENTS 1-211640 8/1989 Japan .
2-78748 3/1990 Japan .

*Primary Examiner*—Raymond A. Nelli
*Attorney, Agent, or Firm*—Foley & Lardner

[57] ABSTRACT

An idling speed control system is provided in an internal combustion engine which has an intake passage led to cylinders of the engine, a throttle valve installed in the intake passage, a bypass passage bypassing the throttle valve and an air-flow controller installed in the bypass passage for controlling the amount of air flowing in the bypass passage. The system comprises a first device which detects an engine torque which causes a fluctuation of rotation speed of the engine; and a second device which controls the air-flow controller in accordance with the detected engine torque.

5 Claims, 8 Drawing Sheets

IDLING SPEED CONTROL SYSTEM OF INTERNAL COMBUSTION ENGINE

BACKGROUND OF THE INVENTION

1. Field of the Invention

The present invention relates in general to rotation speed control systems of an internal combustion engine, and more particularly to an idling speed control system of an internal combustion engine, which can precisely control the idling speed of the engine to a desired level.

2. Description of the Prior art

In known idling speed control systems of an automotive internal combustion engine, the amount of intake air is feedback-controlled in accordance with a difference between an actual rotation speed of the engine detected by a crankangle sensor and a target rotation speed, and usually a so-called "PI control" is employed for gently increasing or decreasing the intake air amount. The torque produced by the engine is generally proportional to the amount of air-fuel mixture fed to the engine, that is, to the intake air amount. However, since the change in rotation speed of the engine is given in the form of the integral of the torque change, the rotation speed change is somewhat delayed as compared with the change of the intake air amount. Thus, in order to avoid excessive delay, usually the change in intake air amount is controlled relatively gently with respect to the rotation speed change.

Japanese Patent First Provisional Publications Nos. 1-211640 and 2-78748 show measures for improving the above-mentioned slow control. That is, in the measure of the former publication, a so-called "feed-forward" control is employed in which any disturbance causing the fluctuation of rotation speed is detected and a corresponding amount of intake air is instantly fed to the engine based on the detected disturbance. In the measure of the latter publication, a control is employed in which a lowering rate of the rotation speed is monitored and when a sudden lowering of the rotation speed is detected, an intake air compensating degree is increased.

However, in hitherto proposed conventional idling speed control systems including those of the above-mentioned publications, satisfied performance has not be obtained due to their inherent constructions. That is, in the type wherein the feedback control is applied to the intake air amount based on the rotation speed change, a marked control delay occurs inevitably. Thus, in this type, high responsive control is not obtained. While, in the measure of the 1-211640 publication, it is almost impossible to set corrected intake air amount to every types of disturbances. Besides, the intake air compensation can not be properly applied to a rotation speed change which is caused by non-predictable disturbance, such as, change in combustion condition of the engine or the like. Furthermore, in the measure of the 2-78748 publication, it is almost impossible to provide the air intake with a precisely controlled compensation. In fact, suppression of an engine stall tends to induce an excessively high idling speed of the engine.

SUMMARY OF THE INVENTION

It is therefore an object of the present invention to provide an idling speed control system which is free of the above-mentioned drawbacks.

According to a first aspect of the present invention, there is provided an idling speed control system for use in an internal combustion engine which has an intake passage led to cylinders of the engine, a throttle valve installed in the intake passage, a bypass passage bypassing the throttle valve and an air-flow controller installed in the bypass passage for controlling amount of air flowing in the bypass passage. The idling speed control system comprises means for detecting an engine torque which causes a fluctuation of rotation speed of the engine; and means for controlling the air-flow controller in accordance with the detected engine torque.

According to a second aspect of the present invention, there is provided an idling speed control system for use in an internal combustion engine which has an intake passage led to cylinders of the engine, a throttle valve installed in the intake passage, a bypass passage bypassing the throttle valve and an air-flow controller installed in the bypass passage for controlling the amount of air flowing in the bypass passage. The idling speed control system comprises first means for deriving the rotation speed of the engine; second means for deriving the pressure in the intake passage downstream of the throttle valve; third means for providing a desired rotation speed of the engine; fourth means for deriving an actual rotation speed load torque of the engine from both the derived rotation speed and the derived pressure in the intake passage; fifth means for deriving a target rotation speed load torque of the engine from both the derived pressure in the intake passage and the desired rotation speed from the third means; and sixth means for comparing the derived actual rotation speed load torque and the derived target rotation speed load torque thereby to produce an instruction signal representing a corrected air amount which is to be fed to the engine; and seventh means for controlling the air-flow controller in accordance with the instruction signal.

According to a third aspect of the present invention, there is provided an idling speed control system for use in an internal combustion engine having an intake passage led to cylinders of the engine, a throttle valve installed in the intake passage, a bypass passage bypassing the throttle valve and an air-flow controller installed in the bypass passage for controlling the amount of air flowing in the bypass passage. The idling speed control system comprises first means for deriving the rotation speed of the engine; second means for deriving the pressure in the intake passage downstream of the throttle valve; third means for deriving a first corrected air amount from both the detected rotation speed and a target rotation speed; fourth means for deriving a normative torque of the engine from the derived rotation speed of the engine and the detected pressure in the intake passage; fifth means for deriving an actual rotation speed load torque of the engine from both the derived rotation speed and the derived pressure in the intake passage; sixth means for deriving an actually generated torque of the engine from both a fluctuation of the engine rotation speed and the derived actual rotation speed load torque; seventh means for deriving a second corrected air amount with reference to a difference between the actually generated torque of the engine and the normative torque; and eighth means for controlling the air flow controller in accordance with the reference to the first and second corrected air amounts derived by the third and seventh means.

DETAILED DESCRIPTION OF THE INVENTION

Figure 1:
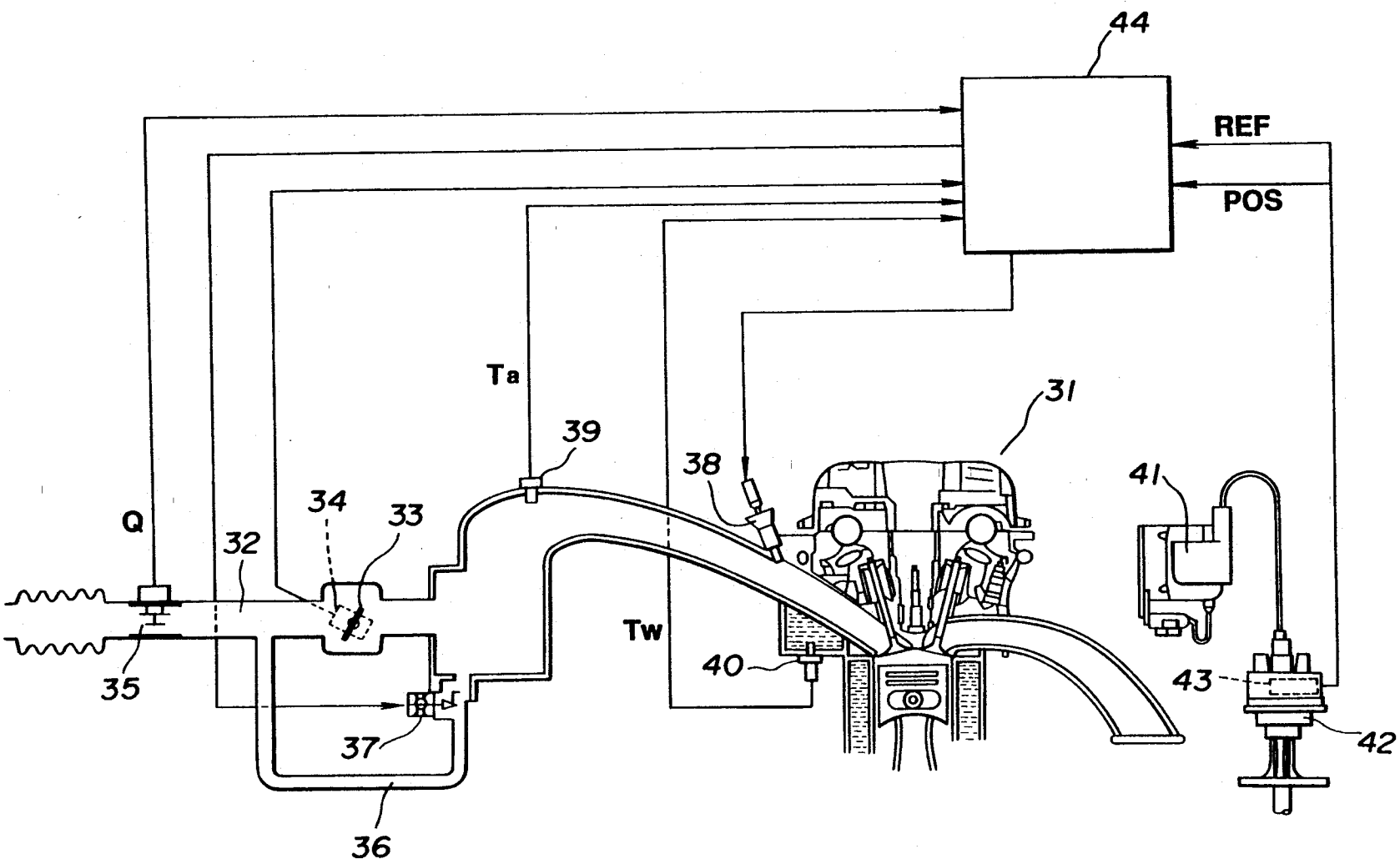
FIG. 1 is a schematic diagram showing the present invention.

Referring to FIG. 1 of the drawings, there is schematically shown an idling speed control system according to the present invention, which is applied to an internal combustion engine 31.

Designated by numeral 32 is an intake passage led to the engine 31 from an air cleaner (not shown). The intake passage 32 has a throttle valve 33 installed therein. A fully closed condition of the throttle valve 33 is sensed by an idle switch (or sensor) 34. Thus, the switch 34 can sense the idling condition of the engine 31. An air flow meter 35 of hot wire type is installed in the intake passage 32 upstream of the throttle valve 33 in order to measure the amount "Q" of intake air passing therethrough. A bypass passage 36 is provided, which bypasses the throttle valve 33. The bypass passage 36 has an air flow controller 37 which controls the air flowing in the bypass passage 36. The air flow controller 37 is of a duty control type electromagnetic valve or a rotary valve which can continuously change the bypassing air flow in accordance with a control signal applied thereto. Within a downstream portion of the intake passage 32 near intake ports of the engine 31, there are installed fuel injection valves 38 from which fuel is injected into the corresponding cylinders of the engine 31. Within the intake passage 32 at a position between the throttle valve 33 and the fuel injection valves 38, there is installed a temperature sensor 39 which detects the temperature "Ta" of the intake air passing through the intake passage 32. Designated by numeral 40 is a cooling water temperature sensor which detects the temperature "Tw" of cooling water in a water jacket of the engine 31.

Designated by numeral 41 is an ignition coil and designated by numeral 42 is a distributor. Within the distributor 42, there is installed a crankangle sensor 43. The crankangle sensor 43 outputs both a reference signal (REF signal) in the form of pulse and an angle position signal (POS signal) in the form of pulse train. The reference pulse signal is generated at a reference position in crankangle of each cylinder, for example, at 60° CA (crankangle) before the top dead center in the explosion stroke. The angle position pulse signal is generated at intervals of given crankangle, for example, at intervals of 1° CA. In order to distinguish pulse signals of the respective cylinders, the reference pulse signal of each cylinder has a different pulse width.

Designated by numeral 44 is a control unit constructed of a microcomputer, into which the information signals of the sensors 35, 34, 39 and 40 are fed through a suitable interface. By treating the information signals, the control unit 44 controls the ignition timing and the fuel injection amount. In addition to this, as will be described in detail hereinafter, the control unit 44 controls in a feedback control fashion the engine idling speed by actuating the air flow controller 37 of the bypass passage 36.

In the following, the operation steps for effecting the idling speed control will be described with reference to the accompanying flowcharts. The operation steps are executed in the computer of the control unit 44.

Figure 2:
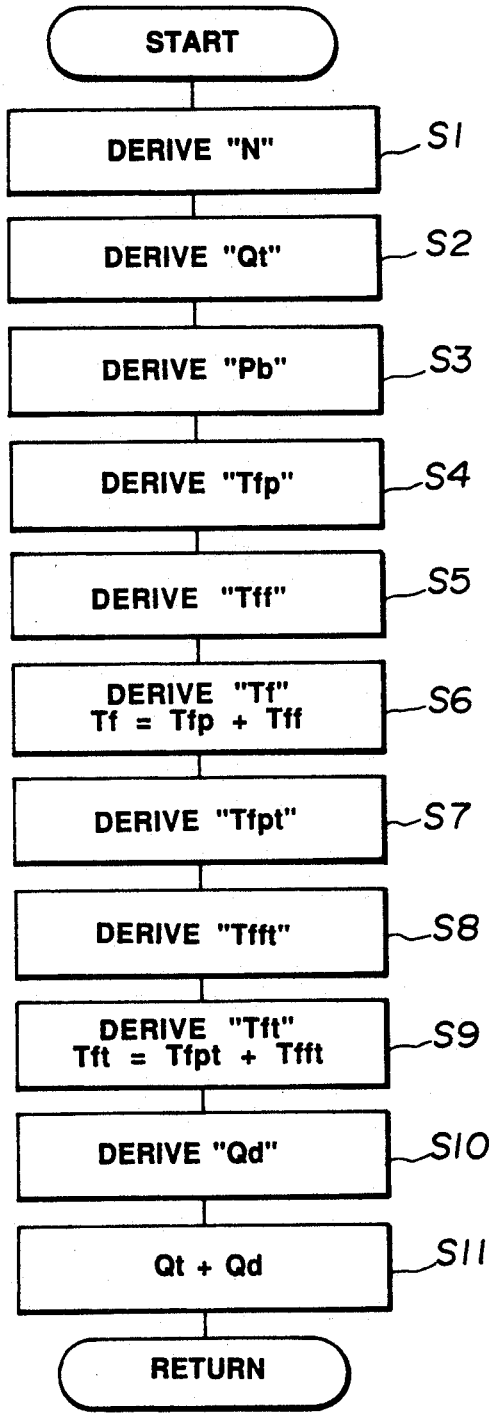
FIG. 2 is a flowchart showing the sequence of operation conducted in the system of a first embodiment of the present invention.

FIG. 2 is a flowchart showing the operation steps carried out in a first embodiment of the present invention. As will become apparent as the description proceeds, in this embodiment, based on the reference signal of each cylinder, the operation steps of the flowchart are carried out as an interruption handling routine at the top dead center in the explosion stroke.

First, at step 1 (viz., "S1" in the flowchart), by treating the reference signal or angle position signal from the crankangle sensor 43, an engine rotation speed "N" is derived. At step 2, a basic corrected air amount "Qt" is derived, which is needed for compensating an increase in engine load caused by those, such as the viscosity of a lubrication oil or the like, which is affected by an engine temperature. The basic corrected air flow amount "Qt" is attained with reference to a map of FIG. 7. The map is provided by using the temperature "Tw" of the cooling water as a parameter. At step 3, the pressure "Pb" in the intake passage 32 downstream of the throttle valve 33 is derived. The pressure "Pb" is calculated from the following equation.

$$Pb = Qm/Vm \quad (1)$$

wherein:

Qm: air amount in a given space of the intake passage 32 downstream of the throttle valve 33, Vm: volume of the given space.

The "Qm" is a value which is derived each time of combustion cycle from the ingress and egress of air, and thus the "Qm" is calculated from the following equation.

$$Qm = Qm_{old} + Q - Q_{out} \quad (2)$$

wherein:

$Qm_{old}$: air amount in a previous combustion cycle;

Q: air amount detected by the air flow meter 35;

$Q_{out}$: air amount discharged.

The "$Q_{out}$" is looked up from a given map based on a previous intake passage pressure "$Pb_{old}$" and the engine rotation speed "N".

If a pressure sensor (not shown) is mounted in the intake passage 32, the intake passage pressure "Pb" can be directly sensed by the sensor. Furthermore, the intake passage pressure "Pb" can be derived from an actual sectional area of the intake passage 32 at the time of engine idling.

At step 4, a pumping loss "Tfp" is derived from the intake passage pressure "Pb". In fact, the pumping loss is looked up from a map which employs the intake passage pressure "Pb" and the engine rotation speed "N" as parameters. At step 5, a friction loss "Tff" is looked up from a map which employs the engine rotation speed as a parameter. At step 6, an actual rotation speed load torque "Tf" is provided by adding the loss "Tfp" and the loss "Tff". The actual rotation speed load torque "Tf" is the load torque generated when the engine runs at the actual engine speed "N".

Figure 5:
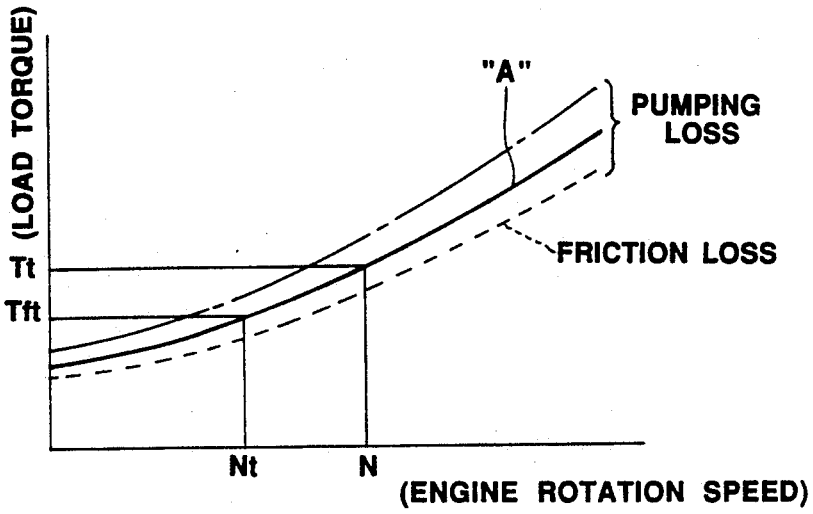
FIG. 5 is a graph showing the relationship between a load torque "Tf" and an engine rotation speed "N"

FIG. 5 is a graph showing the characteristic of the actual rotation speed load torque "Tf" with respect to the engine rotation speed "N". As is seen from the graph, the friction loss "Tff" is determined directly by the engine rotation speed "N", and the load torque "Tf" is provided by adding the pumping loss "Tfp" to the friction loss "Tff". The pumping loss "Tfp" is represented as a value which varies in accordance with the intake passage pressure "Pb". However, if the intake passage pressure "Pb" is constant, the relationship between the load torque "Tf" and the engine rotation speed "N" can be shown by the solid line "A" in FIG. 5.

By carrying out operations of step 7 to step 9, a target rotation speed load torque "Tft" corresponding to a target rotation speed "Nt" is obtained with reference to the characteristic shown by the graph of FIG. 5. That is, at step 7, a pumping loss "Tfpt" corresponding to the target rotation speed "Nt" is obtained from the map of step 4 based on the intake passage pressure "Pb" and the target rotation speed "Nt". In this embodiment, on the assumption that the intake passage pressure "Pb" is not affected by the rotation speed, the intake passage pressure "Pb" obtained at step 3 is used without modification. Then, at step 8, a friction loss "Tfft" corresponding to the target rotation speed "Nt" is obtained from the map of step 5 based on the target rotation speed "Nt". At step 9, both the losses "Tfpt" and "Tfft" are added to obtain the target rotation speed load torque "Tft". As is seen from the graph of FIG. 5, the target rotation speed load torque "Tft" is an estimated value which may be generated when the engine is operated at the target rotation speed "Nt", on the assumption that the intake passage pressure "Pb" never changes. If the intake passage pressure "Pb" under the target rotation speed "Nt" is obtained from a map which uses the throttle valve angle and the target rotation speed "Nt" as parameters, the target rotation speed load torque "Tft" can be obtained with a much higher accuracy.

With the above-mentioned steps, the actual rotation speed load torque "Tf" and the target rotation speed load torque "Tft" are obtained. Then, at step 10, a corrected air amount "Qd" is obtained from the following equation.

$$Qd = Qt \times [(Tft - Tf)/Tft] \quad (3)$$

wherein:

Qt: basic corrected air amount.

The value "Qd" corresponds to a surplus or shortage of torque in case wherein, due to some disturbances, the actual rotation speed load torque "Tf" differs from the target rotation speed load torque "Tft". If the air-fuel ratio is constant, a proportional relationship is established between the amount of air-fuel mixture and the torque generated.

At step 11, the basic corrected air amount "Ot" and the corrected air about "Od" are added to each other to obtain an added value in accordance with which a drive signal is fed to the air flow controller 37.

As is described hereinabove, in the first embodiment, when the engine rotation speed is forced to change due to any disturbance, the air amount is corrected in accordance with the load torque, and thus high responsive idling speed control is achieved.

Figure 6:
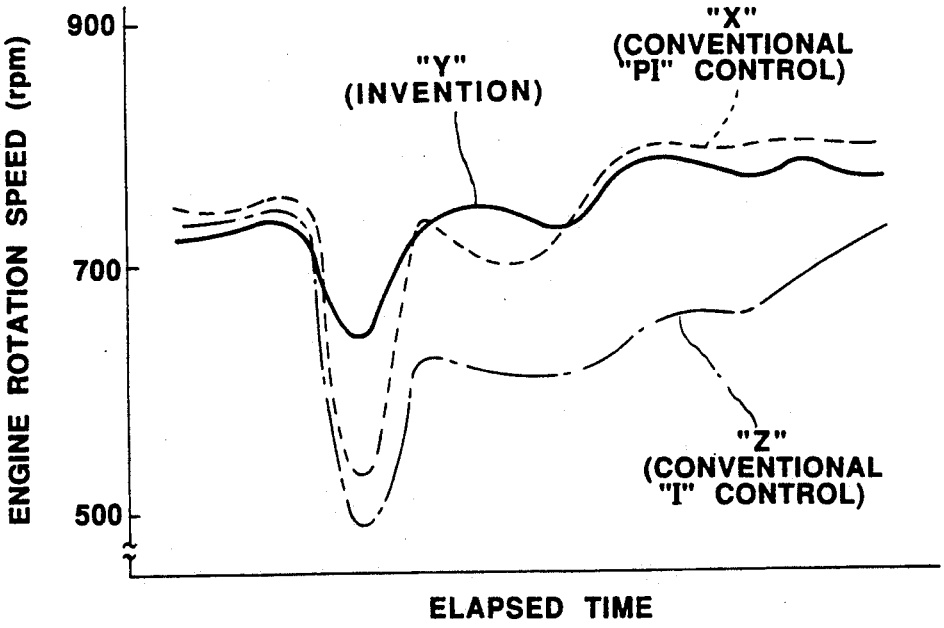
FIG. 6 is a graph showing the characteristic of the present invention and that of a conventional system.

FIG. 6 is a graph showing the engine idling speed characteristic of three controls in case wherein the engine starts to drive a compressor of an air conditioner. As is seen from the graph, in the conventional "PI" and "I" controls shown by the respective broken and phantom curves "X" and "Z", marked drop in idling speed takes place, however, in the feedback control of the invention shown by the solid curve "Y", such drop is very small.

Figure 3:
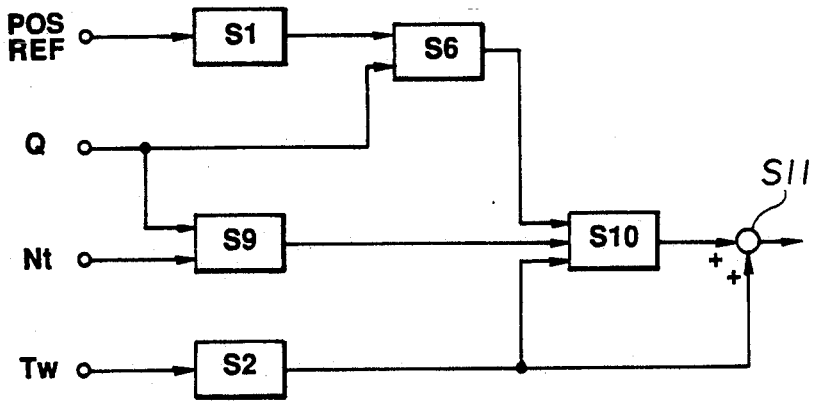
FIG. 3 is a block diagram showing the contents of the operation of the first embodiment.

FIG. 3 is a block diagram which depicts the above-mentioned feedback control of the first embodiment.

Figure 7:
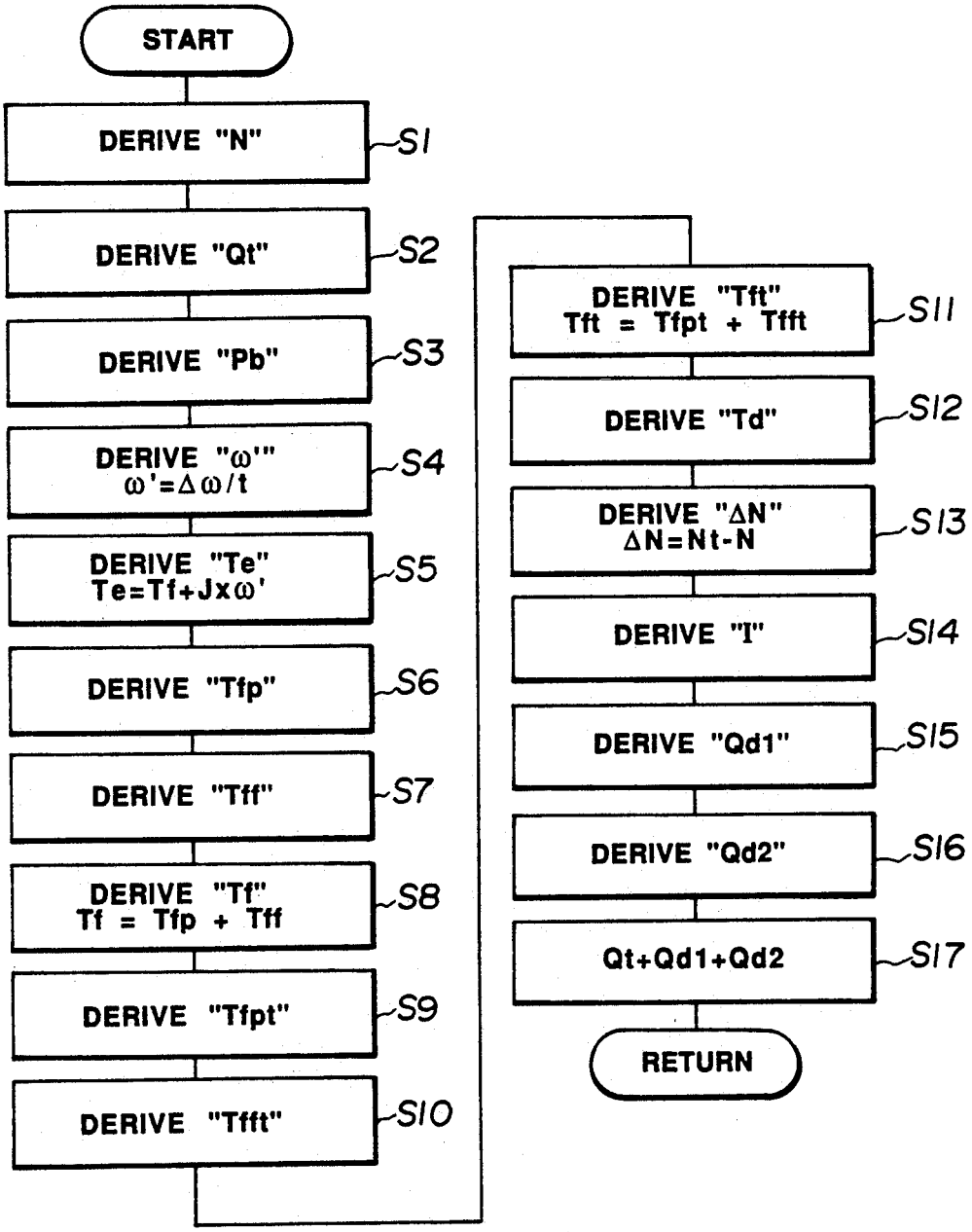
FIG. 7 is a flowchart showing the sequence of operation conducted in the system of a second embodiment of the present invention.

FIG.7 is a flowchart showing the operation steps carried out in a second embodiment of the present invention. Similar to the above-mentioned first embodiment, in this second embodiment, based on the reference signal of each cylinder, the operation steps of the flowchart are carried out as an interruption handling routine at the top dead center in the explosion stroke.

Figure 4:
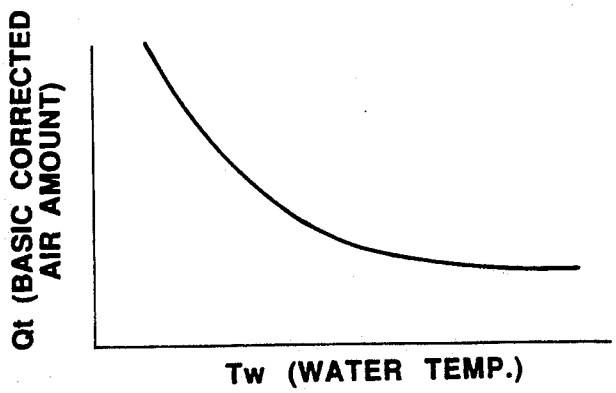
FIG. 4 is a graph showing the characteristic of a basic corrected intake air amount Qt.

First, at step 1 (viz., "S1" in the flowchart), by treating the reference signal or angle position signal from the crankangle sensor 43, an engine rotation speed "N" is derived. At step 2, a basic corrected air amount "Qt" corresponding to the cooling water temperature "Tw" is found from the graph (viz., map) of FIG. 4. At step 3, the pressure "Pb" in the intake passage 32 downstream of the throttle valve 32 is obtained in such a manner as has been described in the first embodiment.

At step 4, a mean angular acceleration "ω'" which represents a small change of the crankangle is obtained. That is, as is seen from FIG. 9, from the engine speed read in synchronization with the reference signal from the crankangle sensor 43, a change "$^{\Delta}\omega$" in angular velocity is derived and the angular velocity change "$^{\Delta}\omega$" is divided by the period "t" (explosion stroke time) between the adjacent two reference signals to obtain the mean acceleration "ω'". That is, the following calculation is carried out for obtaining the means acceleration "ω'".

$$\omega' = {}^{\Delta}\omega / t \quad (4)$$

Figure 9:
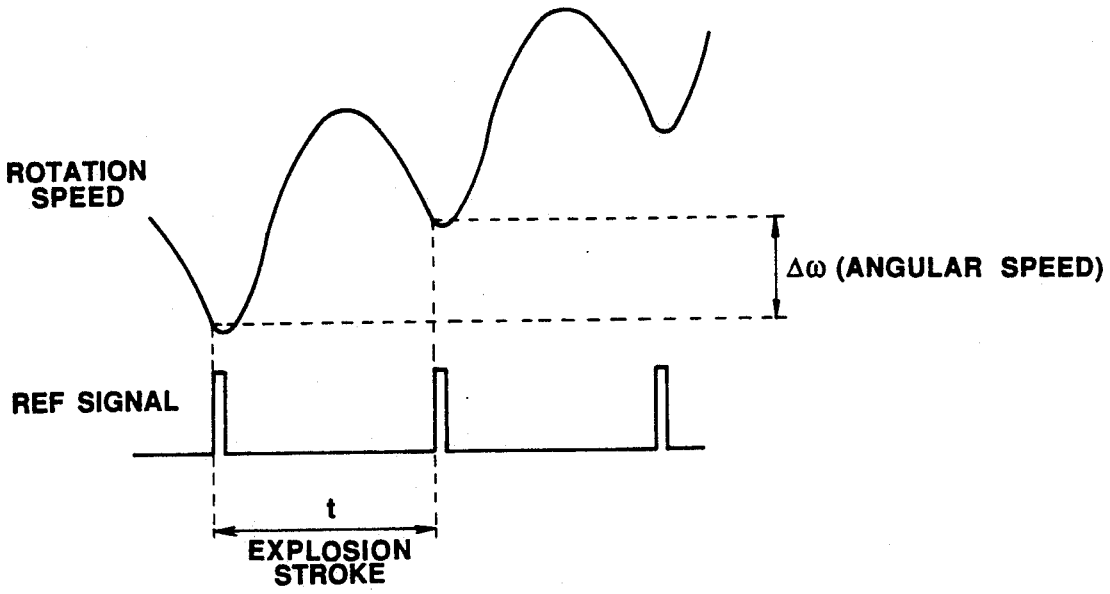
FIG. 9 is a graph showing the relationship between an engine rotation speed change and a reference signal.

As is seen from FIG. 9, the value "ω'" represents the movement of change in engine rotation speed excluding the influence of torque fluctuation caused by the explosion.

At step 5, by using the mean acceleration "ω'", a torque "Te" actually generated by the explosion is derived. The torque "Te" is partially consumed by a load torque, and the remaining portion of the torque "Te" causes the change in engine rotation speed. Thus, the actually generated torque "Te" is obtained from the following equation.

$$Te = Tf + j \times \omega' \quad (5)$$

wherein:

Tf: actual rotation load torque previously obtained, j: inertia of each part of the engine.

At step 6 to step 8, using the intake passage pressure "Pb" obtained at step 3 and the actual rotation speed "N" obtained at step 1, an actual rotation speed load torque "Tf" is obtained. These steps are the same as the steps 4 to 6 of the above-mentioned first embodiment. At step 9 to step 11, a target rotation speed load torque "Tft" corresponding to a target rotation speed "Nt" is obtained in such a manner as described in steps 7 to 9 of the first embodiment. The derivation of the value "Tft" is made on the assumption that the intake passage pressure "Pb" is not affected by the engine rotation speed.

At step 12, by using the actually generated torque "Te", the actual rotation speed load torque "Tf" and the target rotation speed load torque "Tft", a torque deviation "Td" corresponding to the target rotation speed "Nt" is obtained by using the following equation.

$$Td = Te \times [(Tft - Tf)/Tft] \quad (6)$$

The value "Td" represents the deviation degree of the torque.

In this second embodiment, a feedback control based on a derivation of the engine rotation speed is practically used for raising the convergence to a generally gentle change of the rotation speed. That is, at step 13, a deviation "ΔN" (viz., Nt−N) between the actual rotation speed "N" and the target rotation speed "Nt" is derived, and at step 14, in accordance with the positive or negative value of "ΔN", a given controlled variable "ΔI" is added to or subtracted from "ΔN" to obtain an integrated part "I". If desired, the controlled variable "ΔI" may be stepwisely changed in accordance with the degree of the "ΔN".

At step 15, a first corrected air amount "Qd1" is obtained by multiplying the integrated part "I" by a given gain "G1". And at step 16, a second corrected air amount "Qd2" is obtained by multiplying the torque deviation "Td" by a given gain "G2". The derivation of the second corrected air amount "Qd2" from the torque deviation "Td" may be achieved by effecting a suitable calculation using a generally proportional relationship provided therebetween or by looking up a suitable map.

At step 17, the basic corrected air amount "Qt", the first corrected air amount "Qd1" and the second corrected air amount "Qd2" are added to obtain a value in accordance with which a drive signal is applied to the air flow controller 37.

Figure 8:
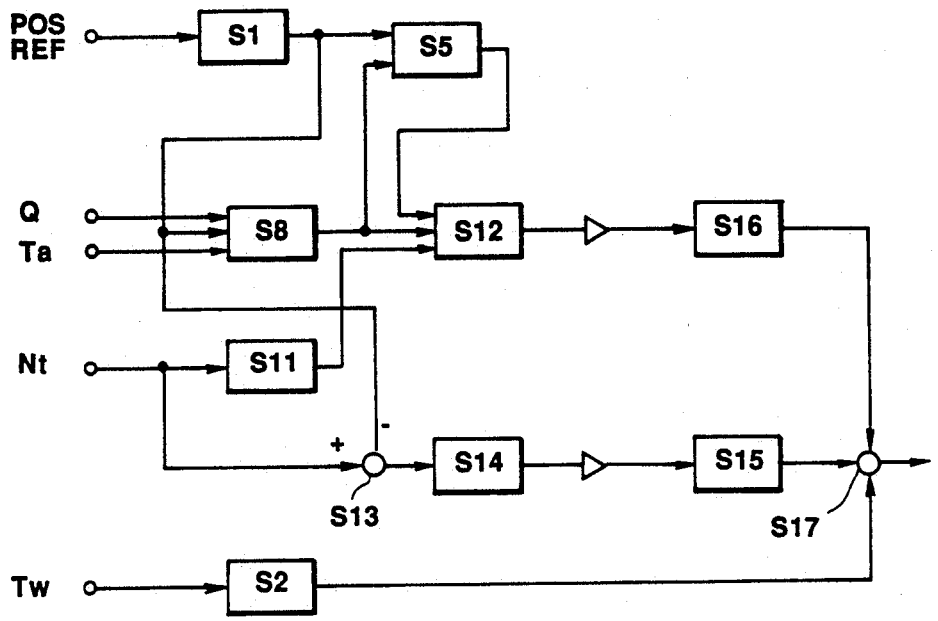
FIG. 8 is a block diagram showing the contents of the operation of the second embodiment.

FIG. 8 is a block diagram which depicts the above-mentioned feedback control of the second embodiment.

In this second embodiment, the change of the actually generated torque "Te" is directly used as the mean acceleration "ω'", on which the second corrected air amount "Qd2" depends. Accordingly, much higher response is obtained against a sudden torque change, and a suitable correction is made to a change in torque "Te" caused by a combustion fluctuation. That is, since, in this second embodiment, the actually generated torque "Te" is obtained each time of combustion cycle, a suitable correction can be made before the time at which a rotation speed change may occur due to the torque fluctuation and thus, the rotation speed change actually made against any disturbance can be controlled relatively small.

Furthermore, in the second embodiment, the feedback control is carried out with the integrated part "I" which is based on the rotation speed deviation "ΔN". Thus, under a relatively stable condition wherein the engine operation is not attacked by a marked disturbance, the engine rotation speed "N" can be precisely controlled to the target rotation speed "Nt" by the "I" control based on the rotation speed deviation "ΔN". That is, a stable engine rotation is quickly achieved against a disturbance by the feedback control which is based on the torque deviation "Td", and the control accuracy to the target rotation speed "Nt" becomes high. This will be well understood from the graph of FIG. 6 in which the rotation fluctuation characteristic possessed by the conventional "I" control is depicted by the curve illustrated by the phantom line "Z".

In the above-mentioned second embodiment, the actually generated torque "Te" is calculated from the rotation speed change of the engine. However, in an arrangement wherein a pressure sensor is installed in each cylinder; the actually generated torque "Te" can be derived from a pressure change sensed by the sensor.

Figure 10:
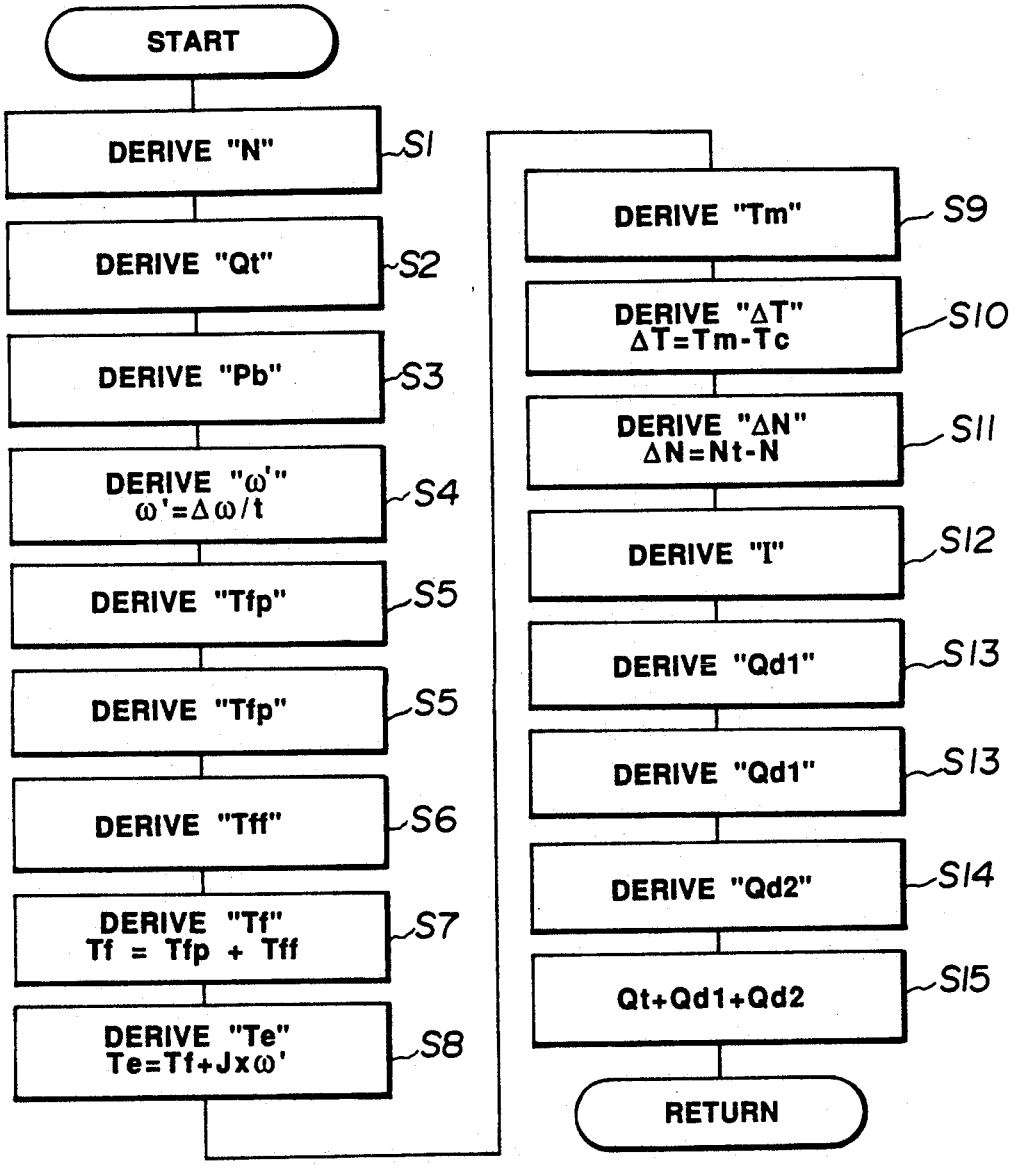
FIG. 10 is a flowchart showing the sequence of operation conducted in the system of a third embodiment of the present invention.

FIG. 10 is a flowchart showing the operation steps carried out in a third embodiment of the present invention. Similar to the above-mentioned two embodiments, in this third embodiment, based on the reference signal of each cylinder, the operation steps of the flowchart are carried out as an interruption handling routine at the top dead center in the explosion stroke.

First, at step 1 (viz., "S1"), an engine speed "N" is derived. At step 2, a basic corrected air amount "Qt" is derived, and at step 3, the pressure "Pb" in the intake passage 32. The operations of these steps are the same as those of the above-mentioned first and second embodiments.

At step 4, a mean angular acceleration "ω'" which represents a small change of the crankangle is obtained. Similar to step 4 of the above-mentioned second embodiment, the mean angular acceleration "ω'" is obtained from the equation which is "$\omega' = \Delta_{\omega/\tau}$". At step 5 to step 7, an actual rotation speed load torque "Te" is obtained from the intake passage pressure "Pb" at step 3 and the actual rotation speed "N" at step 1. These steps are the same as the step 4 to step 6 of the above-mentioned first embodiment.

At step 8, by using both the means angular acceleration "ω'" and the actual rotation speed load torque "Tf", an actual torque "Te" which is actually generated due to explosion in the engine is obtained. That is, by using the above-mentioned equation (5), the actually generated torque "Te" is obtained.

At step 9, a normative torque "Tm" which should be generated upon such explosion is estimated. The normative torque "Tm" is the torque which is generated by an engine which runs under a normal condition wherein the rotation speed is "N" and the intake passage pressure is "Pb". In fact, the normative torque "Tm" is looked up from a map whose parameters are the engine rotation and the intake passage pressure.

At step 10, a deviation "ΔT" (=Tm−Te) between the normative torque "Tm" and the actually generated torque "Te" is derived.

At step 11, a deviation "ΔN" (viz., Nt−N) between the actual rotation speed "N" and the target rotation speed "Nt" is derived, and at step 12, in accordance with the positive or negative value of "ΔN", a given controlled variable "ΔI" is added to or subtracted from "ΔN" to obtain an integrated part "I". That is, the same steps as those of steps 13 and 14 of the above-mentioned second embodiment are carried out.

At step 13, a first corrected air amount "Qd1" is obtained by multiplying the integrated part "I" by a given gain "G1". And at step 14, a second corrected air amount "Qd2" is obtained by multiplying the torque deviation "ΔT" by a given gain "G2". Thus, the second corrected air amount "Qd2" is substantially proportional to the torque deviation "ΔT". However, if the gain relative to the torque deviation "ΔT" corresponding to the combustion fluctuation range is reduced by a given degree, the second corrected air amount "Qd2" can be controlled in a non-linear fashion.

At step 15, the basic corrected air amount "Qt", the first corrected air amount "Qd1" and the second corrected air amount "Qd2" are added to obtain a value in accordance with which a drive signal is applied to the air flow controller 37.

Figure 11:
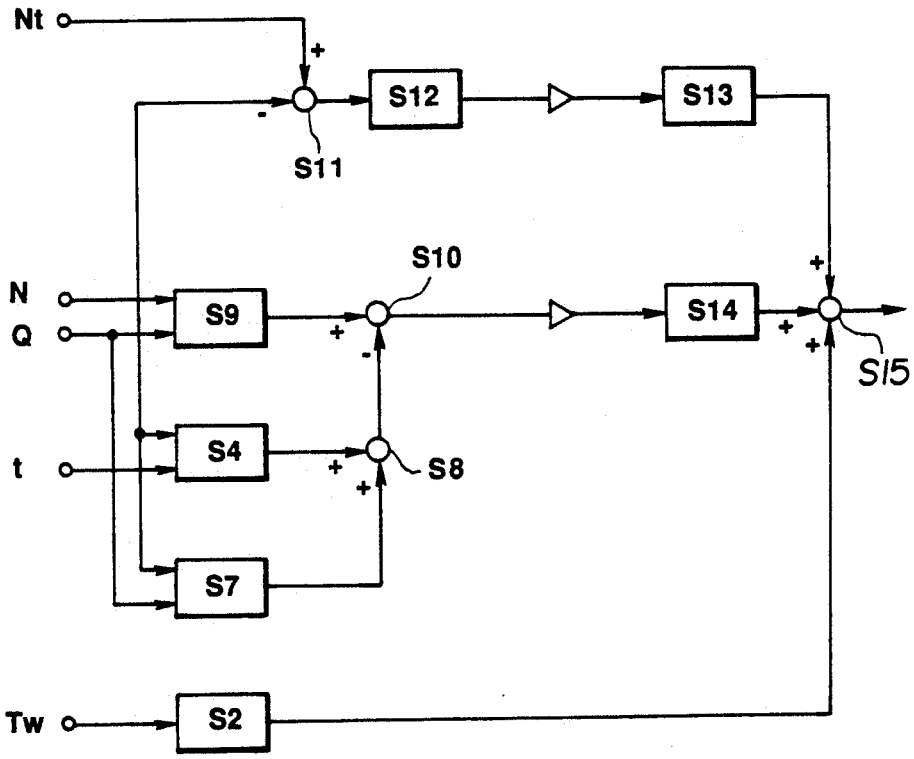
FIG. 11 is a block diagram showing the contents of the operation of the third embodiment.

FIG. 11 is a block diagram which depicts the above-mentioned feedback control of the third embodiment.

In this third embodiment, in a relatively stable condition wherein the engine is not attacked by a marked disturbance, the engine rotation speed "N" can be precisely controlled to the target rotation speed "Nt" by the "I" control based on the rotation speed deviation "ΔN". When, under this relatively stable condition, a certain disturbance is applied to the engine operation, a deviation between the actually generated torque "Te" and the normative torque "Tm" is detected from a small change of the rotation speed, and instantly, the air amount is corrected in a manner to compensate the change of the engine torque. That is, in this third embodiment, the second corrected air amount "Qd2" works to constantly reduce the rotation speed fluctuation caused by any disturbance, so that a very stable rotation of the engine is achieved. Thus, with an aid of the above-mentioned "I" control based on the rotation deviation "ΔN", a stable engine rotation is quickly achieved against any disturbance, and the control accuracy to the target rotation speed "Nt" is high. Particularly, since, in this third embodiment, before the time at which a rotation speed change may take plate, a correction is made to the air amount for matching the actually generated torque "Te" to the normative torque "Tm", undesired rotation speed drop due to driving of an auxiliary device (such as a compressor of air conditioner or the like) can be controlled to a very small level.

As is described in the foregoing description, in the idling speed control system of internal combustion engine according to the present invention, the corrected air amount is controlled in a feedback fashion in accordance with an engine torque deviation. Thus, undesired control delay, which tends to occur when the feedback control is made based on a rotation speed deviation, is eliminated or at least minimized. That is, in the invention, responsibility to disturbance is improved and stable engine idling is achieved.

That is, in the first embodiment, the corrected air amount is obtained by making a comparison of load torque. This means unnecessity of detecting an actually generated torque and thus induces a simple construction of the idling speed control system.

In the second embodiment, since the actually generated torque is constantly monitored, a rapid deviation in torque caused by disturbance and a deviation in generated toque caused by combustion fluctuation can be quickly handled. That is, an appropriate correction can be made to the air flow amount before the time when a rotation speed change may actually occur, and thus, an idling speed deviation caused by a combustion fluctuation and the like can be reduced to a very small level.

In the third embodiment, responsibility and stability of the engine idling against any disturbance and control accuracy to a desired engine idling speed are both improved. That is, by using the normative torque, a sufficient correction can be made to the intake air amount before the time when a marked rotation speed deviation may take place.

What is claimed is:

1. In an internal combustion engine having an intake passage led to cylinders of the engine, a throttle valve installed in said intake passage, a bypass passage bypassing said throttle valve and an air-flow controller installed in said bypass passage for controlling the amount of air flowing in said bypass passage, an idling speed control system comprising:

first means for deriving the rotation speed of said engine;

second means for deriving the pressure in said intake passage downstream of said throttle valve;

third means for providing a desired rotation speed of said engine;

fourth means for deriving an actual rotation speed load torque of the engine from both the derived rotation speed and the derived pressure in said intake passage;

fifth means for deriving a target rotation speed load torque of the engine from both the derived pressure in said intake passage and the desired rotation speed from said third means; and sixth means for comparing the derived actual rotation speed load torque and the derived target rotation speed load torque thereby to produce an instruction signal representing a corrected air amount which is to be fed to the engine; and seventh means for controlling said air-flow controller in accordance with said instruction signal.

2. An idling speed control system as claimed in claim 1, further comprising:

eighth means for deriving a torque generated by said engine; and ninth means for modifying said instruction signal from said sixth means with reference to said torque derived by said eighth means.

3. In an internal combustion engine having an intake passage led to cylinders of the engine, a throttle valve installed in said intake passage, a bypass passage bypassing said throttle valve and an air-flow controller installed in said bypass passage for controlling the amount of air flowing in said bypass passage, an idling speed control system comprising:

first means for deriving the rotation speed of the engine;

second means for deriving the pressure in said intake passage downstream of said throttle valve;

third means for deriving an actual rotation speed load torque of the engine from both the derived rotation speed of the engine and the derived pressure in said intake passage downstream of said throttle valve;

fourth means for deriving a target rotation speed load torque of the engine from both the derived pressure in said intake passage and a target rotation speed of the engine;

fifth means for comparing said actual rotation speed load torque and said target rotation speed load torque thereby to derive a corrected value of air amount fed to the engine; and sixth means for controlling said air flow controller in accordance with the corrected value of air amount derived by said fifth means.

4. In an internal combustion engine having an intake passage led to cylinders of the engine, a throttle valve installed in said intake passage, a bypass passage bypassing said throttle valve and an air-flow controller installed in said bypass passage for controlling the amount of air flowing in said bypass passage, an idling speed control system comprising:

first means for deriving the rotation speed of the engine:

second means for deriving the pressure in said intake passage downstream of said throttle valve;

third means for deriving an actual rotation speed load torque of the engine from both the derived rotation speed of the engine and the derived pressure in said intake passage downstream of the throttle valve;

fourth means for deriving a target rotation speed load torque of the engine from both the derived pressure in said intake passage and a target rotation speed of the engine;

fifth means for deriving a torque of the engine generated due to an explosion in the engine;

sixth means for deriving a torque deviation with reference to both a difference between said actual rotation speed load torque and said target rotation speed load torque and the torque derived by said fifth means;

seventh means for deriving a corrected value of air amount fed to the engine from said torque deviation derived by said sixth means; and eighth means for controlling said air flow controller in accordance with the corrected value of air amount derived by said seventh means.

5. In an internal combustion engine having an intake passage led to cylinders of the engine, a throttle valve installed in said intake passage, a bypass passage bypassing said throttle valve and an air-flow controller installed in said bypass passage for controlling the amount of air flowing in said bypass passage, an idling speed control system comprising:

first means for deriving the rotation speed of the engine;

second means for deriving the pressure in said intake passage downstream of the throttle valve;

third means for deriving a first corrected air amount from both the detected rotation speed and a target rotation speed;

fourth means for deriving a normative torque of the engine from the derived rotation speed of the engine and the detected pressure in the intake passage;

fifth means for deriving an actual rotation speed load torque of the engine from both the derived rotation speed and the derived pressure in the intake passage;

sixth means for deriving an actually generated torque of the engine from both a fluctuation of the engine rotation speed and the derived actual rotation speed load torque;

seventh means for deriving a second corrected air amount with reference to a difference between said actually generated torque of the engine and said normative torque; and eighth means for controlling said air flow controller in accordance with reference to said first and second corrected air amounts derived by said third and seventh means.

* * * * *